United States Patent [19]

O'Rourke

[11] 3,991,751

[45] Nov. 16, 1976

[54] PORTABLE VIBRATOR

[75] Inventor: Jessie O'Rourke, Indianola, Okla.

[73] Assignee: The Raymond Lee Organization, Inc., New York, N.Y. ; a part interest

[22] Filed: Aug. 18, 1975

[21] Appl. No.: 605,616

[52] U.S. Cl. ..... 128/36; 128/79

[51] Int. Cl.[2] ..... A61H 19/00

[58] Field of Search ..... 128/32, 34–36, 128/41, 79

[56] References Cited

UNITED STATES PATENTS

| | | | |
|---|---|---|---|
| 3,183,538 | 5/1965 | Hubner | 128/36 |
| 3,451,391 | 6/1969 | Tavel | 128/36 |

OTHER PUBLICATIONS

RAS Enterprises July 1, 1971.

RAS Enterprises, Sept. 30, 1974, p. 34.

*Primary Examiner*—Lawrence W. Trapp

*Attorney, Agent, or Firm*—Daniel Jay Tick

[57] ABSTRACT

A tubular housing is dimensioned to be held in a hand and has an open neck end. The housing has a predetermined diameter throughout its length and a diameter smaller than the predetermined diameter at the neck end thereof and is rounded down at its neck end from the predetermined diameter to the smaller diameter. A head is removably affixed to the housing at the neck end thereof and has the predetermined diameter at an intermediate part thereof. The head has the smaller diameter at the end affixed to the housing and is rounded down at its affixed end from the predetermined diameter to the smaller diameter thereby forming an annular trough-like indentation in the area of the neck end of the housing. An electric vibrating device in the housing vibrates the head.

3 Claims, 2 Drawing Figures

PORTABLE VIBRATOR

DESCRIPTION OF THE INVENTION

The present invention relates to a portable vibrator.

Objects of the invention are to provide a portable vibrator of simple structure, which is inexpensive in manufacture, and is dimensioned and shaped to avoid abrasion of the skin of the user thereby avoiding any possible cancerous lesions, so that the vibrator functions safely, as well as efficiently, effectively and reliably.

Figure 1:
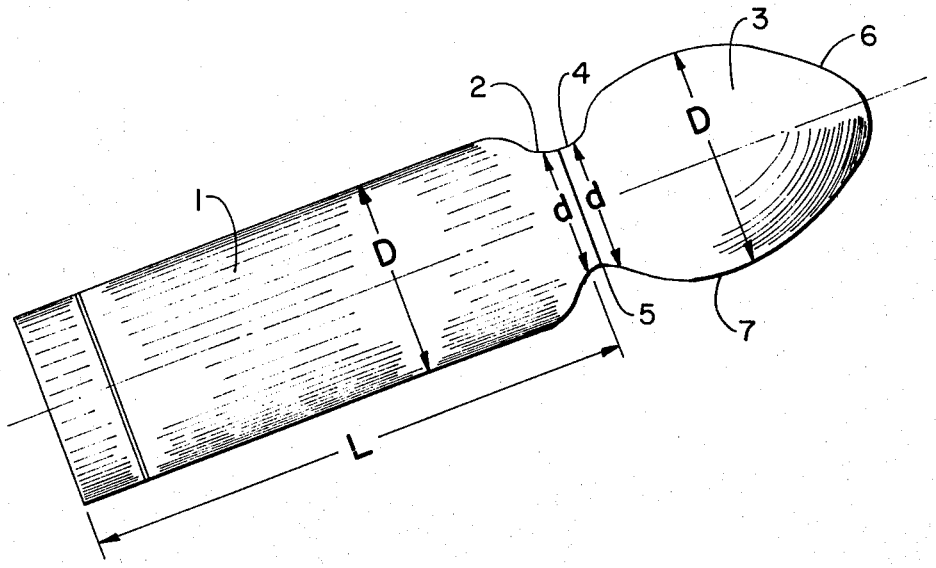
Figure 2:
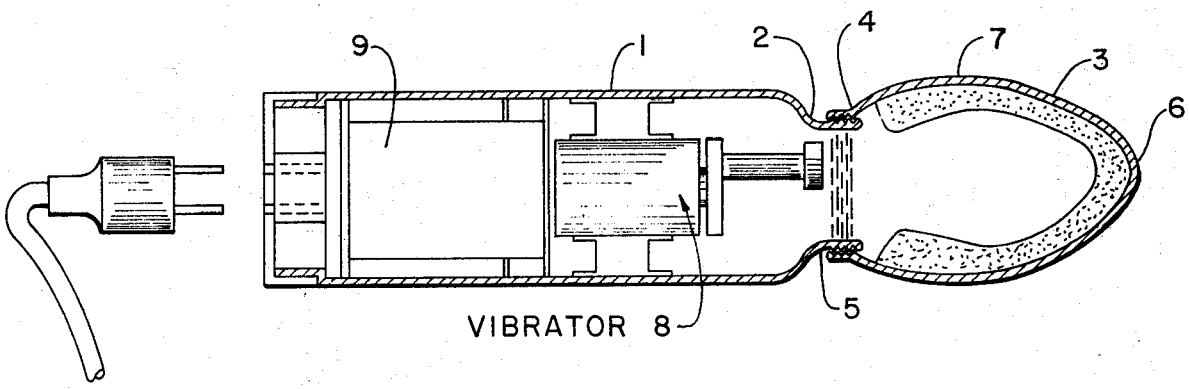

In order that the invention may be readily carried into effect, it will now be described with reference to the accompanying drawing, wherein:

FIG. 1 is a perspective view of an embodiment of the portable vibrator of the invention; and FIG. 2 is a view, partly in section, of the embodiment of FIG. 1.

The portable vibrator of the invention comprises a substantially tubular housing 1 dimensioned to be held in a hand and having an open neck end 2. The housing 1 has a predetermined diameter D throughout its length L (FIG. 1) and a diameter *d* smaller than the predetermined diameter D at the neck end 2 thereof, as shown in FIG. 1. As shown in the FIGS., the housing 1 is rounded down at its neck end 2 from the predetermined diameter D to the smaller diameter *d*.

A head 3 is removably affixed to the housing 1 at the neck end 2 thereof. The head 3 has substantially the predetermined diameter D at an intermediate part thereof, as shown in FIG. 1, and substantially the smaller diameter *d* at the end 4 affixed to the housing, as shown in FIG. 1. As shown in the FIGS., the head 3 is rounded down at its affixed end 4 from the predetermined diameter D to the smaller diameter *d* thereby forming a substantially annular trough-like indentation 5 in the area of the neck end 2 of the housing 1.

The head preferably comprises rubber and has a free end 6 opposite the end 4 thereof affixed to the housing.

The head 3 has a generally conical rounded configuration from the intermediate part 7.

An electric vibrating device 8 of any suitable known type is provided in the housing 1 for vibrating the head 3. The vibrating device 8 may be powered by any suitable source of electrical energy 9, such as, for example, a stepdown transformer connected to a commercial power source, or any suitable type of battery or batteries.

While the invention has been described by means of a specific example and in a specific embodiment, I do not wish to be limited thereto, for obvious modifications will occur to those skilled in the art without departing from the spirit and scope of the invention.

I claim:

1. A portable vibrator, comprising a substantially tubular housing dimensioned to be held in a hand and having an open neck end, said housing having a predetermined diameter throughout its length and a diameter smaller than the predetermined diameter at the neck end thereof and being rounded down at its neck end from the predetermined diameter to the smaller diameter;

a head removably affixed to the housing at the neck end thereof and having substantially the predetermined diameter at an intermediate part thereof and substantially the smaller diameter at the end affixed to the housing and being rounded down at its affixed end from the predetermined diameter to the smaller diameter thereby forming a substantially annular trough-like indentation in the area of the neck end of the housing; and electric vibrating means in the housing for vibrating the head.

2. A portable vibrator as claimed in claim 1, wherein the head has a free end opposite the end thereof affixed to the housing and having a generally conical rounded configuration from the intermediate part.

3. A portable vibrator as claimed in claim 1, wherein the head comprises rubber.

* * * * *